US008069915B2

(12) United States Patent
Lynde

(10) Patent No.: US 8,069,915 B2
(45) Date of Patent: Dec. 6, 2011

(54) NON-METALLIC WHIPSTOCK

(75) Inventor: Gerald D. Lynde, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/543,310

(22) Filed: Aug. 18, 2009

(65) Prior Publication Data

US 2009/0301706 A1 Dec. 10, 2009

Related U.S. Application Data

(62) Division of application No. 11/403,107, filed on Apr. 12, 2006, now abandoned.

(51) Int. Cl.
*E21B 7/08* (2006.01)

(52) U.S. Cl. ..... 166/117.6; 175/81

(58) Field of Classification Search ..... 166/117.5, 166/117.6, 255.3, 50; 175/81
See application file for complete search history.

(56) References Cited

U.S. PATENT DOCUMENTS

| | | | |
|---|---|---|---|
| 2,331,293 | A | 10/1943 | Ballard |
| 4,182,423 | A | 1/1980 | Ziebarth et al. |
| 5,199,513 | A | 4/1993 | Stewart et al. |
| 5,277,251 | A | 1/1994 | Blount et al. |
| 5,398,754 | A | 3/1995 | Dinhoble |
| 5,467,820 | A | 11/1995 | Sieber |
| 5,494,111 | A | 2/1996 | Davis et al. |
| 5,499,680 | A | 3/1996 | Walter et al. |
| 5,507,346 | A | 4/1996 | Gano et al. |
| 5,544,704 | A | 8/1996 | Laurel et al. |
| 5,566,757 | A | 10/1996 | Carpenter et al. |
| 5,725,060 | A | 3/1998 | Blount et al. |
| 5,909,770 | A | 6/1999 | Davis |
| 6,386,287 | B2 | 5/2002 | George |
| 6,419,010 | B1 | 7/2002 | Begg |
| 6,419,012 | B1 | 7/2002 | George et al. |
| 6,419,021 | B1 | 7/2002 | George et al. |
| 6,419,023 | B1 | 7/2002 | George et al. |
| 6,419,024 | B1 | 7/2002 | George et al. |
| 6,497,288 | B2 | 12/2002 | George et al. |
| 6,766,859 | B2 | 7/2004 | Haugen et al. |
| 2002/0029889 | A1 | 3/2002 | George et al. |
| 2006/0027359 | A1 | 2/2006 | Carter et al. |

FOREIGN PATENT DOCUMENTS

| | | |
|---|---|---|
| EP | 0701040 | 3/1996 |
| EP | 0733775 | 9/1996 |

OTHER PUBLICATIONS

Garfield, Garry, et al., "Coiled Tubing Re-Entry Whipstocks: The Next Evolutionary Step in Drilling Practices for Mature-Filed Development", SPE/IADC 105853, Feb. 2007, 1-5.

(Continued)

*Primary Examiner* — David Bagnell
*Assistant Examiner* — David Andrews
(74) *Attorney, Agent, or Firm* — Steve Rosenblatt

(57) ABSTRACT

A whipstock that is totally to substantially non-metallic is made preferably from a composite material. The body can include one or more stiffeners that are also preferably non-metallic. The mounting lug for the window mill can also be non-metallic. A metallic base can be used to connect to an anchor. Optionally the ramp can include a plate that is optionally internally supported. Alternatively the ramp can include hardened inserts or other wear resistant material. Composite materials that can be molded are preferred.

4 Claims, 4 Drawing Sheets

OTHER PUBLICATIONS

Mackenzie, G.R.J., et al., "Coiled-Tubing-Deployed Re-Entry Whipstocks-Technology Overview and Case Histories" SPE 103645, Aug. 2006, 1-4.

Mackenzie, Gordon R.J., et al., "Overview Dissemination of Case Histories Pertaining to Re-Entry Whipstocks from a Coiled Tubbing Deployed Perspective", SPE 106343, May 2006, 4 pages.

Dewey, Charles H., et al., "Planning for Successful Window Milling Operation", SPE 49255, Sep. 1998, 727-732.

NON-METALLIC WHIPSTOCK

PRIORITY INFORMATION

This application is a divisional application claiming priority from U.S. patent application Ser. No. 11/403,107, filed on Apr. 12, 2006.

FIELD OF THE INVENTION

The field of this invention is whipstocks for creating laterals from wellbores and more particularly to whipstocks that are substantially non-metallic.

BACKGROUND OF THE INVENTION

Frequently in the life of a well additional laterals are needed to properly and more fully produce a formation. Whipstocks are properly positioned in the wellbore and oriented so that the lateral will exit in the proper direction into the target formation. Whipstocks are typically anchored from below and feature a ramp surface in the range of about 3 degrees. As a result the whipstock body is generally fairly long and features a lug near its upper end to allow a window mill to be delivered with it. After proper orientation and anchoring, the window mill is started and it breaks loose from its mounting lug and begins to make the exit or window in the surrounding tubular.

The whipstocks are typically milled from a metal cylinder stock in a process that takes a great deal of time to mill away a ramp that can be over 15 feet long. The resulting rigidity of the whipstock also makes it difficult to manipulate it in deviated wellbores and risks breaking the connection between the window mill and the lug when running in.

Whipstocks have always been made this way. The present invention is a departure from this tradition in that it results in a streamlined manufacturing process that is easier to run in and yet comparably performs to the traditional totally metallic designs. Examples of the whipstocks now in use are illustrated in U.S. Pat. Nos. 6,766,859; 6,497,288; 6,419,024; 6,419,023; 6,419,021; 6,419,012; 6,419,010; 6,386,287; 5,725,060; 5,507,346; 5,499,680; 5,467,820; 5,277,251; 5,199,513 and US Publication Number 2002/0029889. The last reference shows the use of a polymeric coating on the whipstock to protect its metal body and to ease the advancement of a washover tool over the top of the whipstock if it needs to be retrieved.

Apart from the prior art mentioned above, an older technique presents an alternative to milling a whipstock from a metal cylinder. FIGS. 1-3 illustrate the method. A tubular 10 gets a half circumferential cut 12 and two opposed tapered cuts 14 and 16. The cut piece 18 is removed and inverted, as shown in FIG. 3 and welded back into position and the result is a ramp to an opening 20. One disadvantage here is the presence of a piece of the tubular 22 that has an internal diameter 24 which can limit the diameter of the window mill that can fit though and still make the turn on the ramp formed by cut piece 18. FIG. 4 shows a typical milled whipstock 26 that has a retrieval slot 28 and a lug 30 for initial support from a window mill 32. The window is produced in the tubular 34.

The present invention will be more readily understood by those skilled in the art from the discussion of the preferred embodiment and the related drawings and from the claims that define the scope of the invention.

SUMMARY OF THE INVENTION

A whipstock that is totally to substantially non-metallic is made preferably from a composite material. The body can include one or more stiffeners that are also preferably non-metallic. The mounting lug for the window mill can also be non-metallic. A metallic base can be used to connect to an anchor. The ramp can include a plate that is optionally internally supported. Alternatively the ramp can include hardened inserts or other wear resistant material. Composite materials that can be molded are preferred.

DETAILED DESCRIPTION OF THE DRAWINGS

Figure 1:
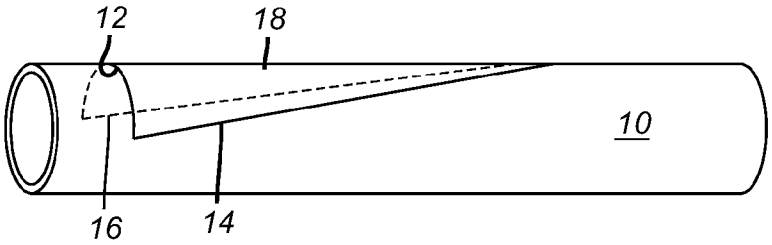
(PRIOR ART) FIG. 1
FIGS. 1-3 illustrate a prior art method of creating a whipstock without milling a cylinder.
Figure 2:
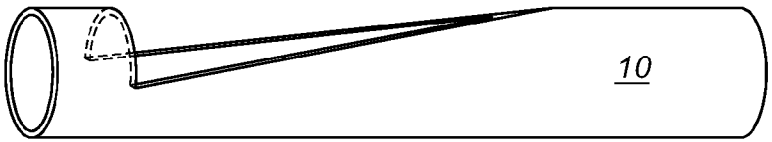
(PRIOR ART) FIG. 2
Figure 3:
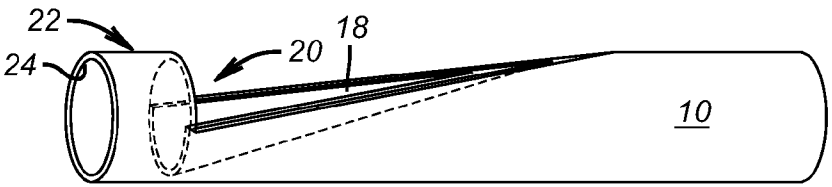
(PRIOR ART) FIG. 3
Figure 4:
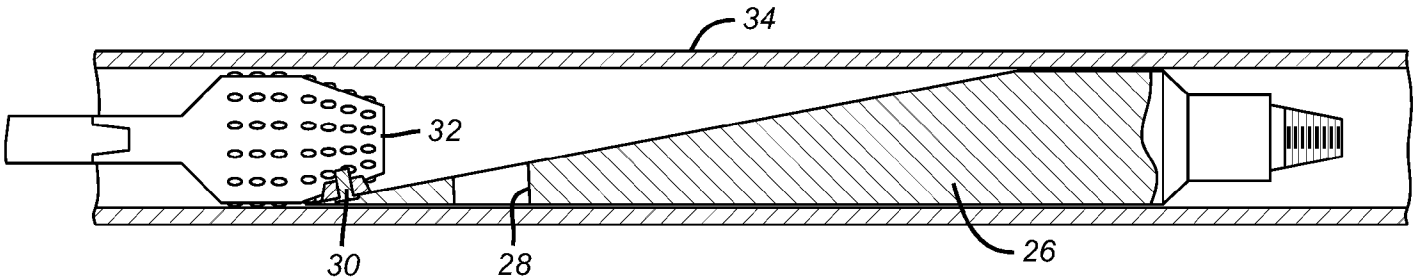
(PRIOR ART) FIG. 4
FIG. 4 is a section view of a typical assembly of a metallic whipstock delivered to a location supported off a window mill attached to a lug at the upper end of the whipstock.
Figure 5:
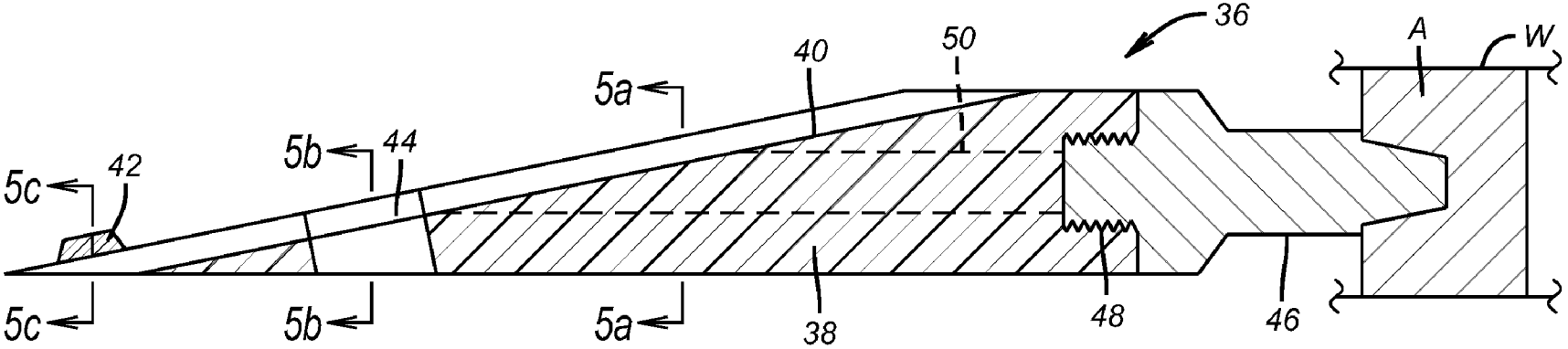
Figure 5C:
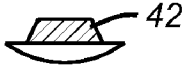
Figure 7:
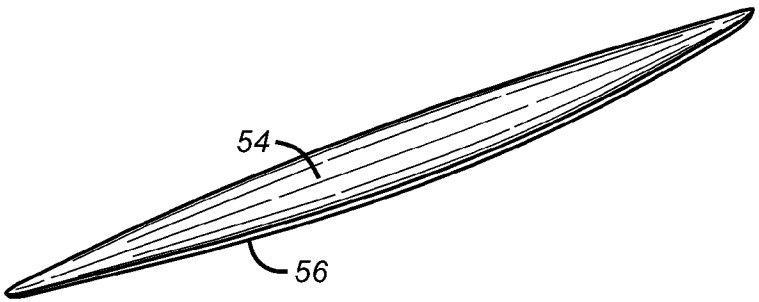
Figure 6:
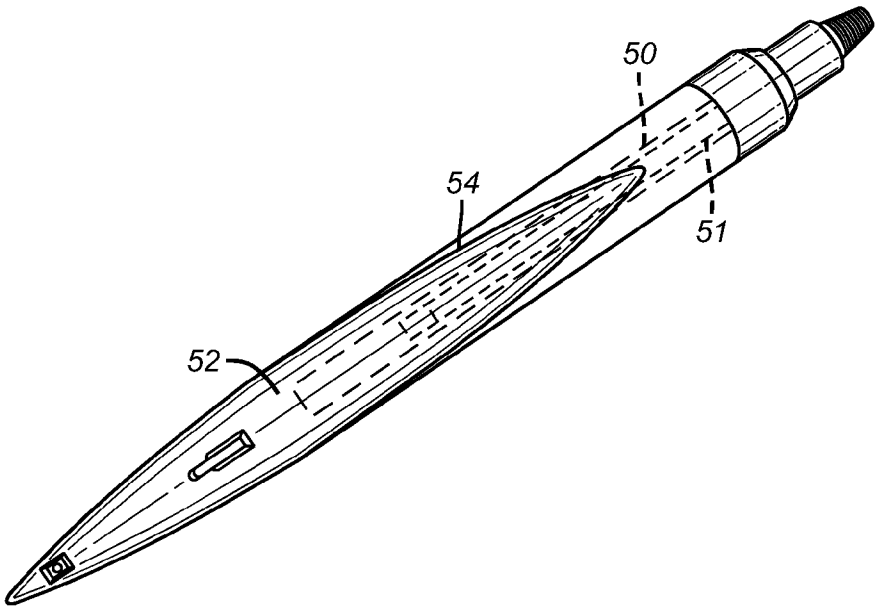
Figure 8:
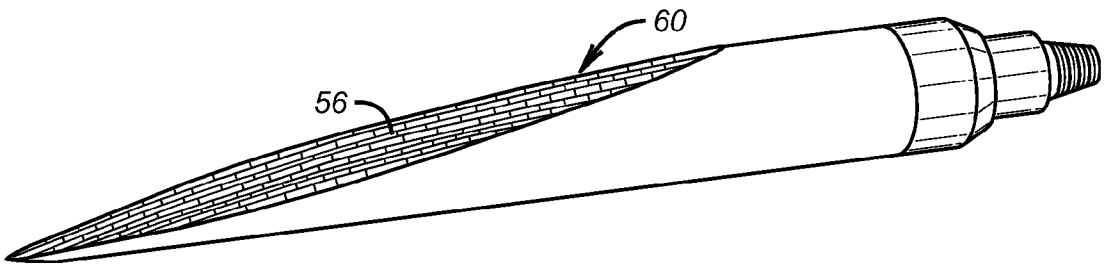
Figure 9:
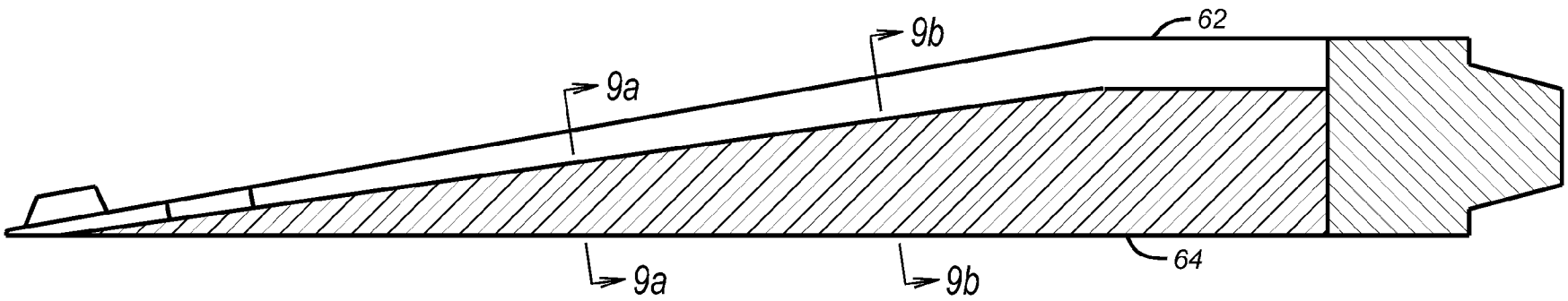
Figure 9B:
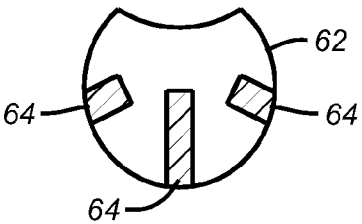
Figure 9A:
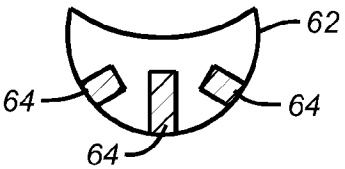

FIGS. 5, 5*a-c* show an overall non-metallic whipstock with section views along its length;

FIGS. 6 and 7 show a non-metallic whipstock having a ramp surface that can accept a wear plate and FIG. 7 shows a wear plate that fits on the ramp surface;

FIG. 8 shows a non-metallic ramp with imbedded hardened material to improve wear resistance;

FIGS. 9 and 9*a-b* shows a variation of the whipstock shown in FIG. 5 that features body stiffeners.

DETAILED DESCRIPTION OF THE PREFERRED EMBODIMENT

Figure 5B:
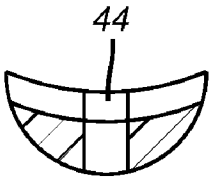
Figure 5A:
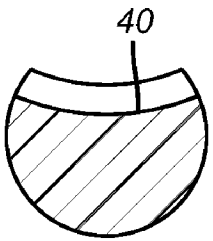

FIG. 5 shows a whipstock 36 that has a non-metallic body 38 including the ramp 40. Mounting lug 42 is disposed on the ramp 40 and can be the same material as the body 38. It can be made integrally to the body 38 or it can be a built up structure attached to it by bonding, adhesives or other comparable techniques. FIG. 5*a* shows the arc shape of the ramp 40 while FIG. 5*b* shows the retrieval slot 44 that extends into the ramp 40. A bottom sub 46 is preferably metallic and connects to the body 38 at thread 48. Sub 46 is typically connected to an anchor A supported off a wellbore wall W and may optionally be an integral or separate component of the body 38 and be of a non-metallic material. A passage 50 may extend from sub 46 to ramp 40. One purpose for passage 50 is shown in FIGS. 6 and 7. FIG. 6 shows a ramp 52 and a slide 54 that is designed to be attached to ramp 52 to make the ramp 52 more resistant to during the window milling. The slide 54 can be metallic and can be secured to ramp 52 by adhesives or other known techniques. Optionally, the slide 54 can have a through the body rod member 51 attached to its underside 56 and that rod inserted through passage 50 shown in FIG. 5. If that is done the rod 51 can transmit impacts to the slide 54 directly to the sub 46 and to an anchor (not shown) below as opposed to the body 38 absorbing the impact loads.

FIG. 8 shows the use of a wear resistant material, such as carbide inserts, 58 that can be in the ramp 60 to improve service life.

FIG. 9 is essentially the same as FIG. 5 except that the body 62 has one or more generally longitudinally oriented stiffeners 64 that are more rigid than body 62 or alternatively can even be from the same material. Although the cross-section of the stiffeners 64 is shown as rectangular, other shapes are envisioned as well as other quantities or differing lengths. The stiffeners can be fully embedded or have a side flush with the body as shown in FIG. 9*b*.

Preferably the whipstock of the present invention can be a composite material that can be injection molded or fabricated from a blank. It can be at least 80% composite or other durable non-metallic substance that is somewhat flexible and not brittle. It can have fiber reinforcement. If desired, the whipstock can be up to fully non-metallic. Making the whipstock this way cuts down on the manufacturing time and reduces cost. Metallic whipstocks require milling away a lot of steel to produce the ramp. Another advantage of the non-metallic whipstock is if it has to be milled out. In that case the procedure is so much quicker. In negotiating well deviations the non-metallic whipstock will run in faster and will be less likely to get stuck. The resulting rigidity can be very comparable to the steel whipstocks while providing the needed column strength with stiffeners and still retaining some degree of flexibility for running in to deviated bores.

Those skilled in the art will appreciate that "non-metallic" is intended to refer to the degree of use of other materials and can encompass a 100% composite design, for example, as well as including as design that may be 80% composite and the rest metallic as illustrated by using the bottom sub 46 or the slide 54 in FIG. 7.

The above description is illustrative of the preferred embodiment and many modifications may be made by those skilled in the art without departing from the invention whose scope is to be determined from the literal and equivalent scope of the claims below:

I claim:

1. A whipstock assembly for forming a window downhole in a surface that defines a wellbore, the assembly adapted to be supported from an anchor secured to the surface that defines the wellbore, comprising:

a body further comprising a ramp wherein said body is non-metallic, said body is formed having a connection adjacent a lower end thereof for engagement with a support;

said ramp further comprises a non-metallic sloping outer surface, said ramp and said non-metallic body providing structural support for a contacting metallic plate secured to said sloping outer surface and substantially covering said ramp, said plate contacted by a mill for forming the window;

said metallic plate supported through said body with a through the body member to transmit load imparted by the mill to said metallic plate through said body and directly to said support.

2. The assembly of claim 1, wherein:

said support comprises a solid bottom sub for sole structural support of said body without use of adhesive between said body and said surface that defines the wellbore;

said bottom sub selectively secured to said anchor off the wellbore bottom, said anchor secured to said inside surface that defines the wellbore.

3. The assembly of claim 2, wherein:

said body comprises a bore extending from said ramp, and said through the body member connected to said plate and extending in said bore.

4. The assembly of claim 3, wherein:

said through the body member rests on said bottom sub.

* * * * *